US011369889B2

(12) United States Patent
Sekreter et al.

(10) Patent No.: US 11,369,889 B2
(45) Date of Patent: Jun. 28, 2022

(54) WATERSLIDE STRUCTURE

(71) Applicant: POLIN SU PARKLARI VE HAVUZ SISTEMLERI ANONIM SIRKETI, Kocaeli (TR)

(72) Inventors: Volkan Sekreter, Kocaeli (TR); Atalay Batuhan Soral, Kocaeli (TR); Utku Onursal, Kocaeli (TR)

(73) Assignee: POLIN SU PARKLARI VE HAVUZ SISTEMLERI ANONIM SIRKETI, Kocaeli (TR)

( * ) Notice: Subject to any disclaimer, the term of this patent is extended or adjusted under 35 U.S.C. 154(b) by 0 days.

(21) Appl. No.: 17/259,944

(22) PCT Filed: Jul. 13, 2018

(86) PCT No.: PCT/TR2018/050372
§ 371 (c)(1),
(2) Date: Jan. 13, 2021

(87) PCT Pub. No.: WO2020/013769
PCT Pub. Date: Jan. 16, 2020

(65) Prior Publication Data

US 2021/0268391 A1 Sep. 2, 2021

(51) Int. Cl.
*A63G 21/18* (2006.01)
*A63G 21/00* (2006.01)

(52) U.S. Cl.
CPC ..... *A63G 21/18* (2013.01)

(58) Field of Classification Search
CPC ..... A63G 1/04; A63G 21/00; A63G 21/02; A63G 21/18; A63G 31/00; A63G 31/007
USPC ..... 472/13, 116–117, 128–129; 104/69, 70
See application file for complete search history.

(56) References Cited

U.S. PATENT DOCUMENTS

| | | | | |
|---|---|---|---|---|
| D706,892 | S | 6/2014 | Altindag et al. | |
| 2004/0077426 | A1 | 4/2004 | Hunter et al. | |
| 2011/0177872 | A1* | 7/2011 | Hunter | A63G 21/18 472/117 |
| 2012/0277011 | A1* | 11/2012 | Hunter | A63G 21/18 472/117 |
| 2014/0135136 | A1 | 5/2014 | Altindag et al. | |

FOREIGN PATENT DOCUMENTS

| | | | |
|---|---|---|---|
| CN | 203123555 | U | 8/2013 |
| WO | 2011057395 | A1 | 5/2011 |

* cited by examiner

*Primary Examiner* — Kien T Nguyen
(74) *Attorney, Agent, or Firm* — Bayramogiu Law Offices LLC

(57) ABSTRACT

A structure for waterslides is provided. The structure includes a body in a form of a prolate ellipsoid compressed or flattened from top and bottom; side walls and a bottom wall; and an open front end for a rider exit; a lateral rider opening for connecting at least a waterslide disposed parallel to at least a side wall of the side walls; where at least a part of the side wall is protruding in a form of a half tubular wall an end of the half tubular wall is connected to the lateral rider opening.

10 Claims, 14 Drawing Sheets

WATERSLIDE STRUCTURE

CROSS REFERENCE TO THE RELATED APPLICATIONS

This application is the national stage entry of International Application No. PCT/TR2018/050372, filed on Jul. 13, 2018, the entire contents of which are incorporated herein by reference.

TECHNICAL FIELD

The present invention relates in general to a new structure for waterslides, specifically a structure for waterslides providing more thriller experience with its unique shape and functions which are used for fun and excitement in waterparks.

BACKGROUND

Waterslides also known as flume, water chute, or hydroslide are popular ride attractions for waterparks, theme parks, and tourist hotels. Waterslides are not just a simple feature for children to play or cooling apparatus for summer heat, they are also irreplaceable fun tool for all kind of people.

In a typical waterslide a rider or a group of riders slides downwardly from higher elevation to lower elevation on a water film which is cooling the riders and lubricating the sliding, surface. A rider who is sliding alone can slide on a mat, tube, raft, boat or his/her own body but a group of riders generally uses boat or different ride vehicles except some special rides. Pump systems are generally use for recirculating water from outlet to inlet thanks to that the mentioned water film is formed continuously on the inner surface of the waterslide. Surface with the water film let the riders or ride vehicles speed up. This is not the only thing which is affecting the speed. Speed of a rider is changeable respect to so many parameters on waterslides. Such as, rider's weight, slope of the sliding surface, water speed, design of the slide (turns, twists and so on), elevation level on the starting point.

Today's waterslides are very popular and common choice for amusement parks. Demand on the related market is so large. So many private people and juristic persons making investments on this area. Municipalities are the well-known example of this.

Park patrons are generally focusing the number of coming people to their waterparks. The key point of increasing that number is about using new and more thriller water slides. If the waterslide is new and provides more thrilling and exciting experience, the waterpark will be visited by much more people. Therefore, the slide manufacturers are always in the search of new designs and concepts.

In the background of the art, some popular design structures are in the shape of a funnel and bowl. The mentioned structures have a single point rider entrance. One problem with the single point entrance is that it significantly limits the alternative paths and trajectories of the riders. Riders move on just one main direction from entrance to exit. Another problem with the single point entrance is arising from the speed variation of the riders. In a waterslide heavier riders gain higher speed and as a result riders climb higher in the waterslide structure. Therefore, the single point entrance must be specified regarding fastest riders to prevent tumbling on the inner surface of the waterslide structure. As a consequence, slow riders (lighter riders) are not able to gain good/thrilling experience from the waterslides.

SUMMARY

Present invention having a unique shape and multipoint lateral rider entrance provides all riders having variable of speeds with good, thrilling ride experience from waterslides.

BRIEF DESCRIPTION OF THE DRAWINGS

An exemplary embodiment of the present invention is illustrated by way of example in the accompanying drawings to be more easily understood and uses thereof will be more readily apparent when considered in view of the detailed description, in which like reference numbers indicate the same or similar elements, and the following figures in which:

FIG. 9 is the perspective view from the front end of the structure for waterslides in one exemplary embodiment of the present invention showing the path of a rider who enters into the rider opening at a speed a.

FIG. 10 is the perspective view from the front end of the structure for waterslides in one exemplary embodiment of the present invention showing the path of a rider who enters into the rider opening at a speed b, b>a.

Figure 1:
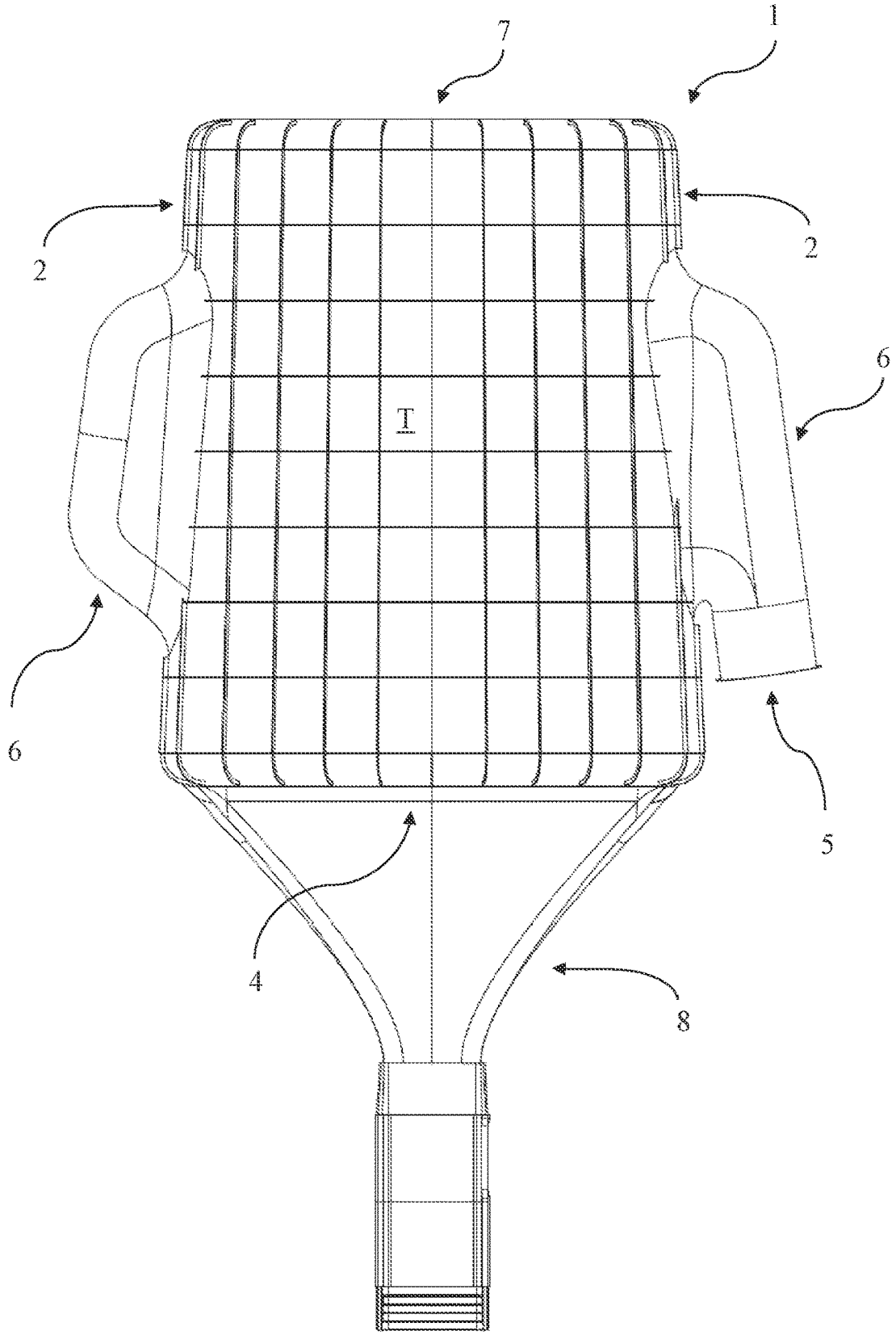
FIG. 1 is the view from the top of the structure for waterslides in one exemplary embodiment of the present invention.
Figure 2:
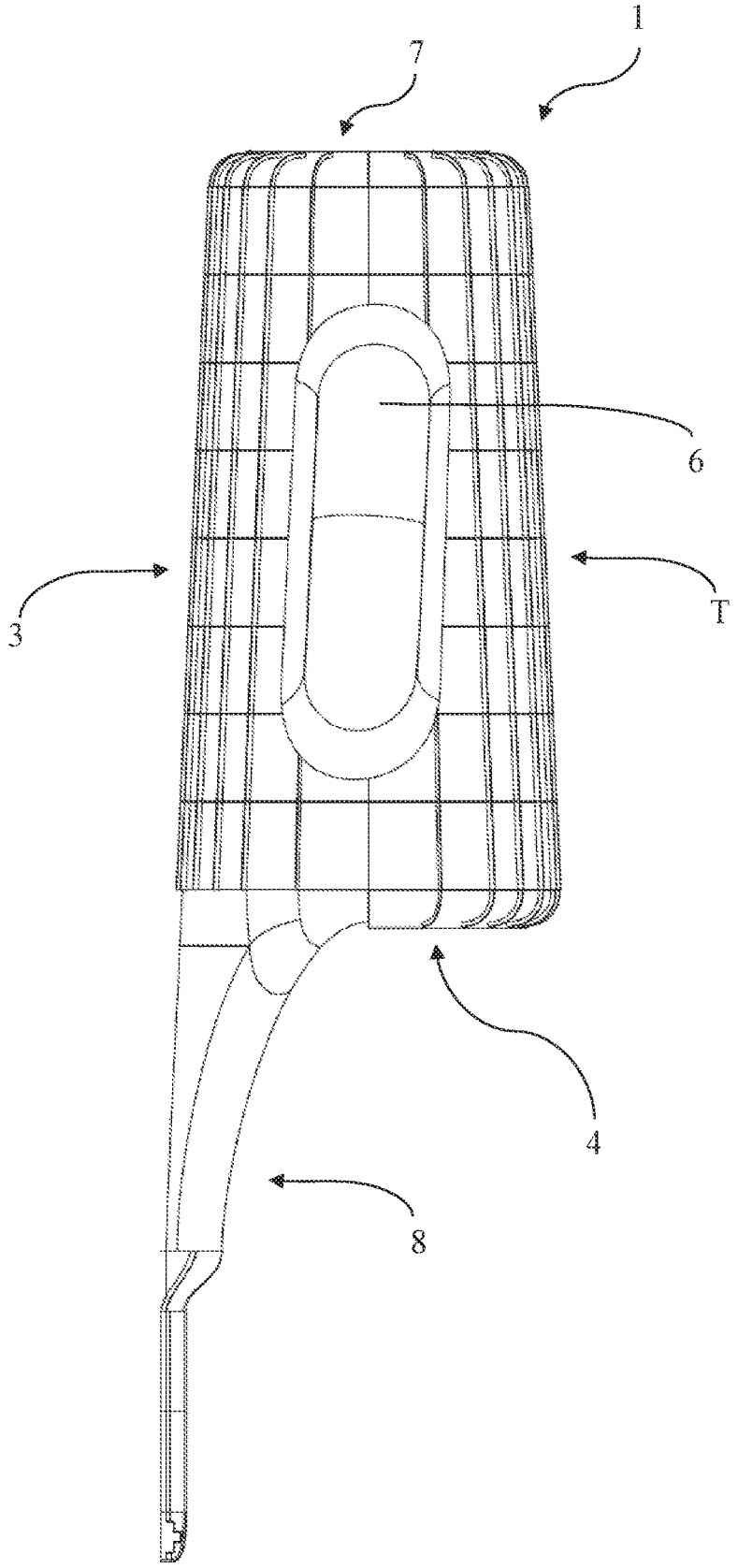
FIG. 2 is the view from the side of the structure for waterslides in one exemplary embodiment of the present invention.
Figure 3:
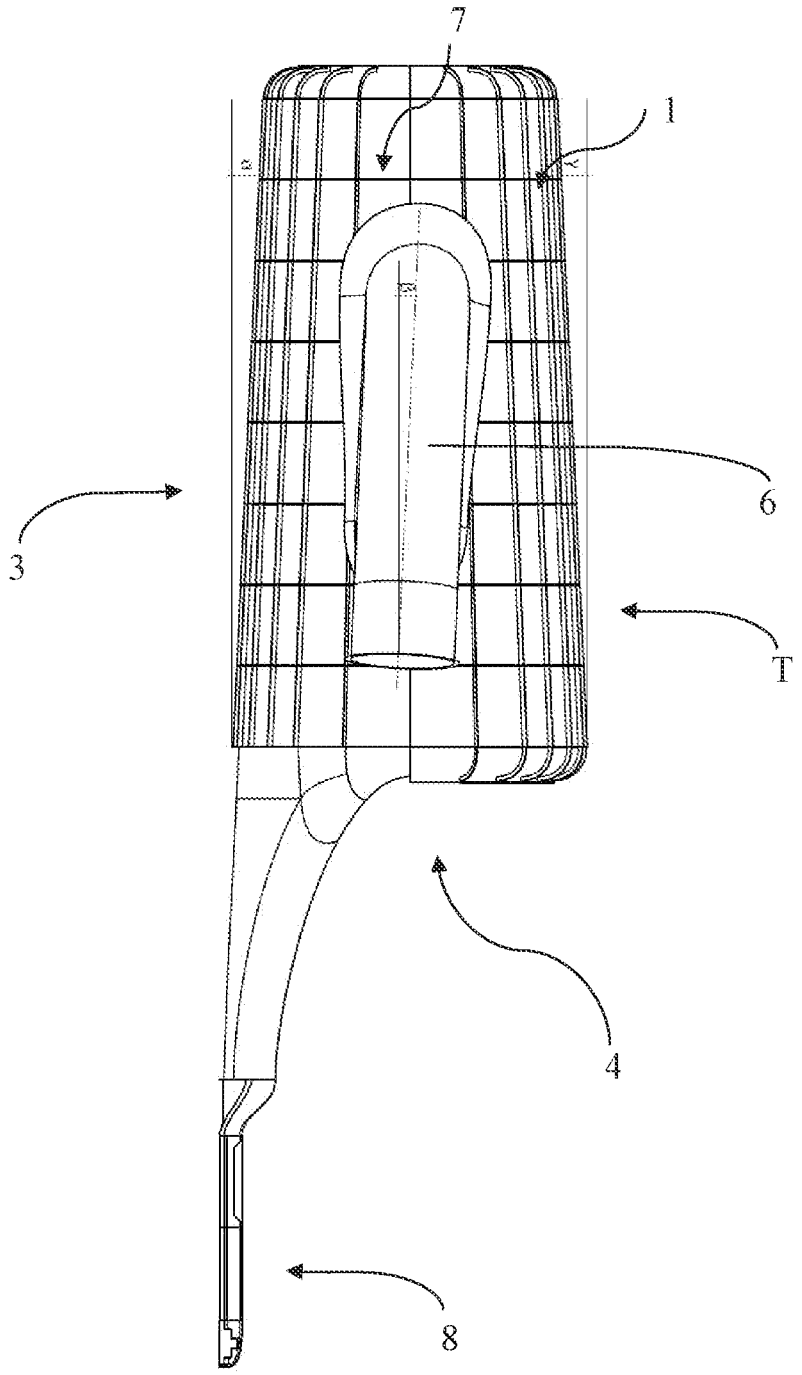
FIG. 3 is the view from the other side of the structure for waterslides in one exemplary embodiment of the present invention where the lateral rider opening and $\alpha$, $\beta$, $\gamma$ angles are shown.
Figure 4:
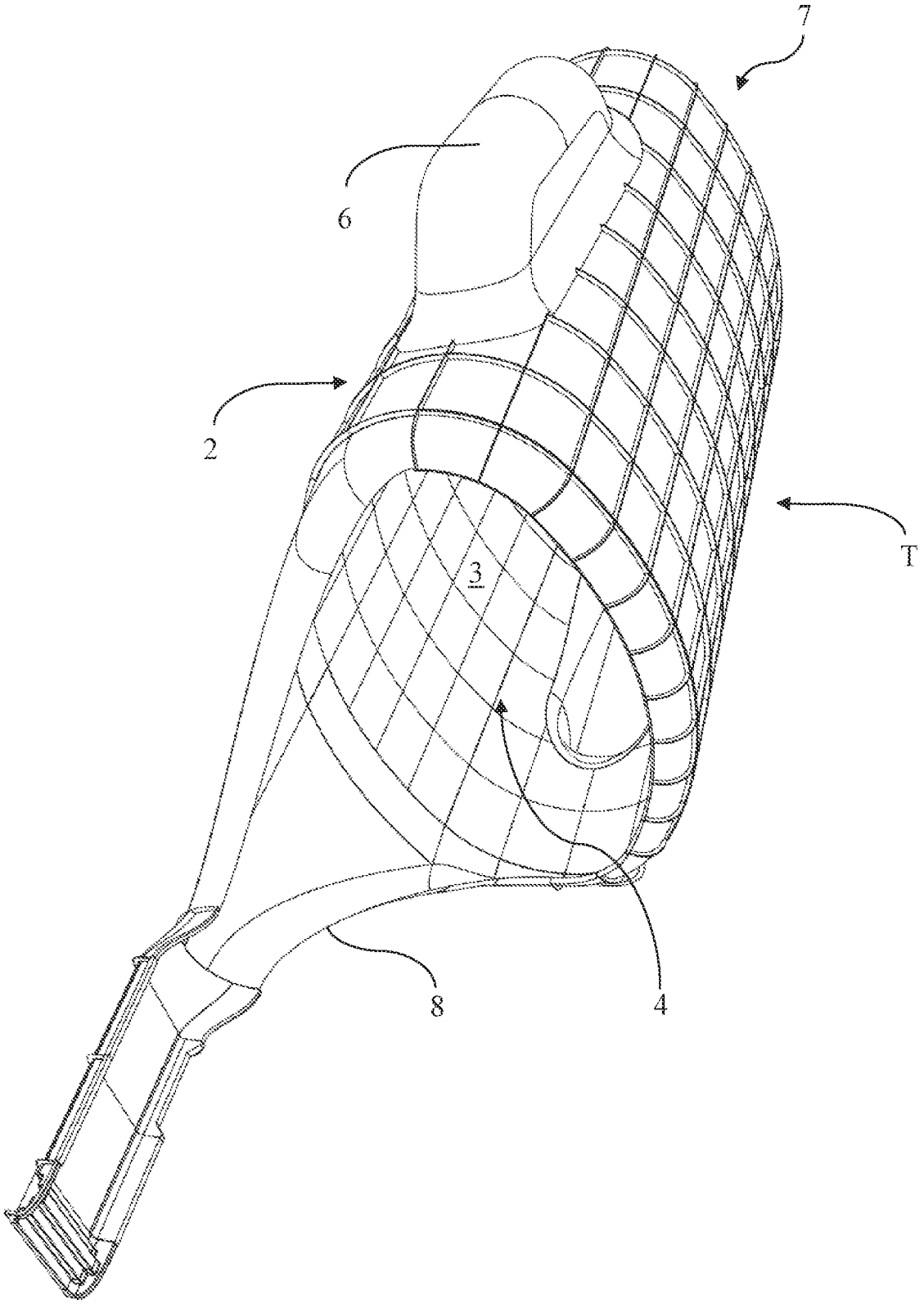
FIG. 4 is the perspective view from the front end of the structure for waterslides in one exemplary embodiment of the present invention where the discharge/pour spout is shown.
Figure 5:
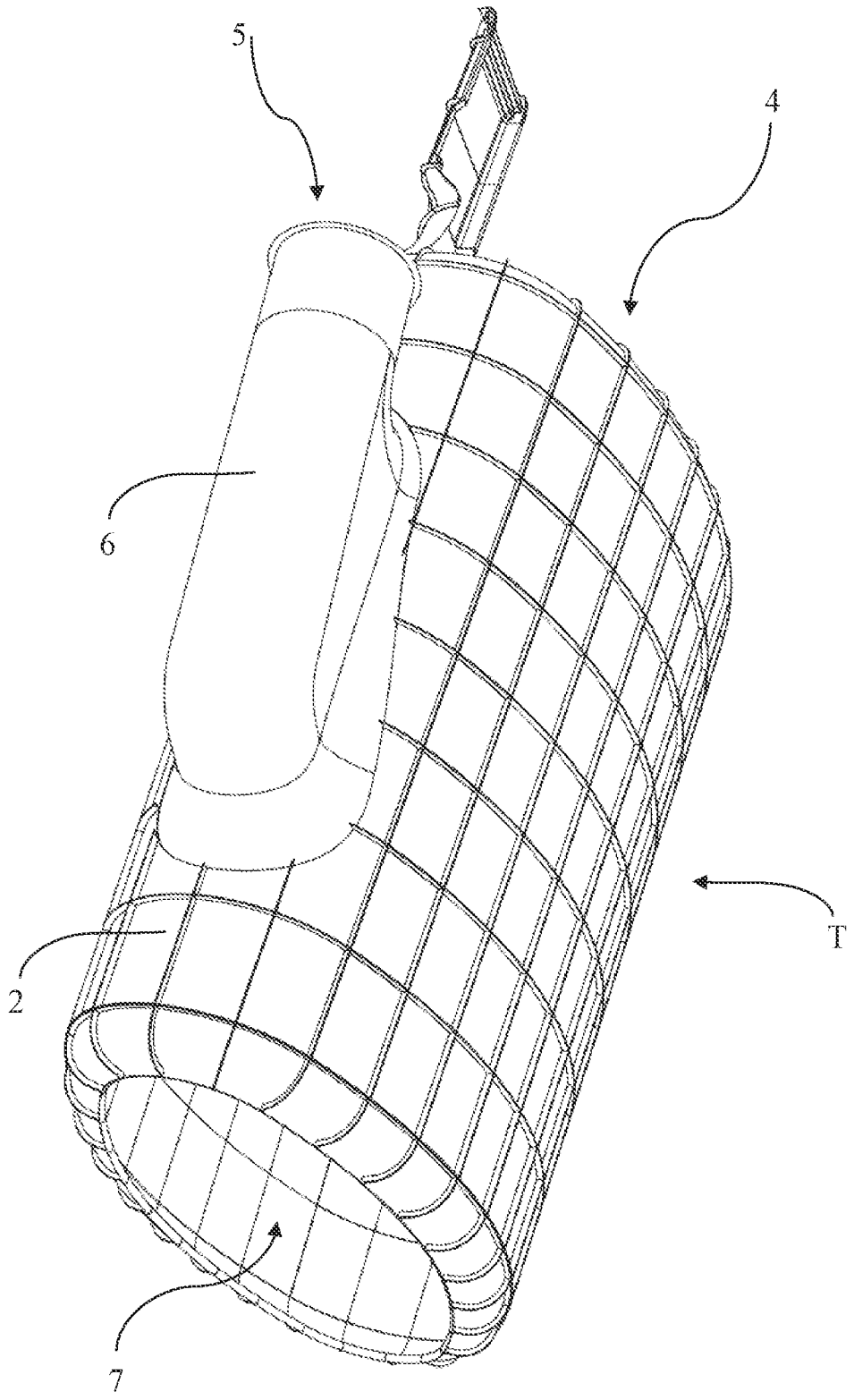
FIG. 5 is the perspective view from the back end of the structure for waterslides in one exemplary embodiment of the present invention where the discharge/pour spout is shown.
Figure 6:
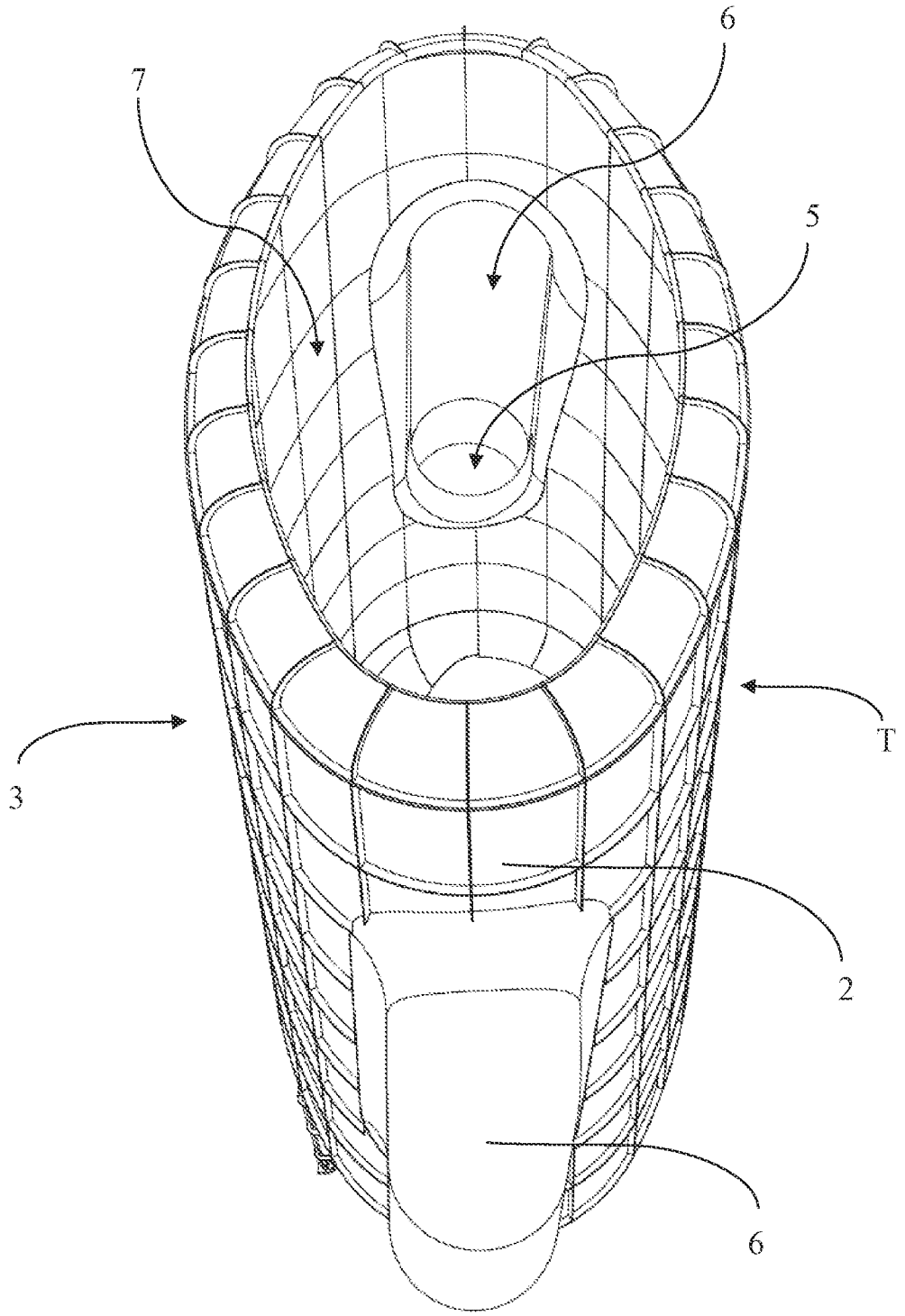
FIG. 6 is the perspective view from the front end of the structure for waterslides in one exemplary embodiment of the present invention.
Figure 7:
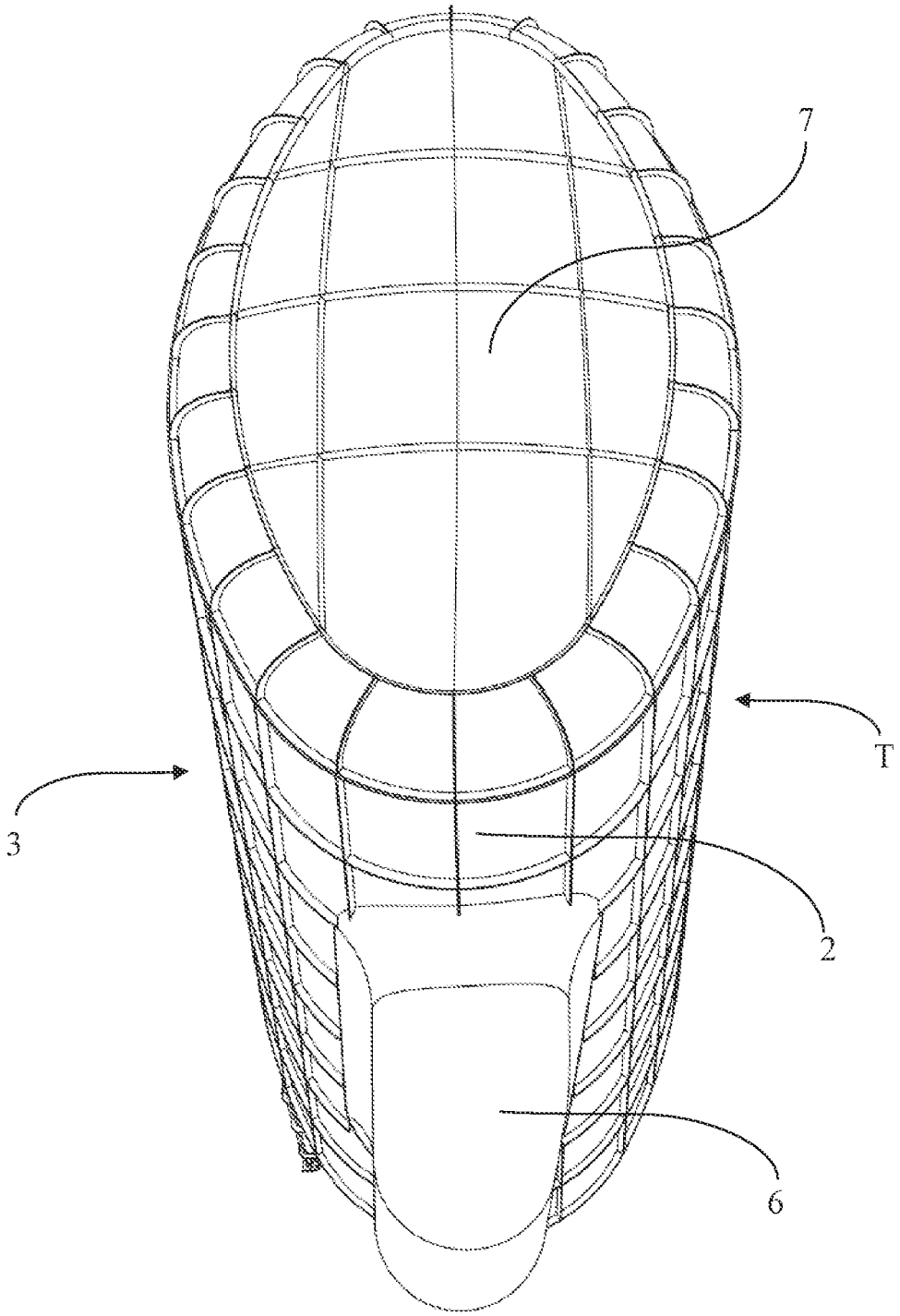
FIG. 7 is the perspective view from the back end the structure for waterslides in one exemplary embodiment of the present invention where the back end is closed.
Figure 8:
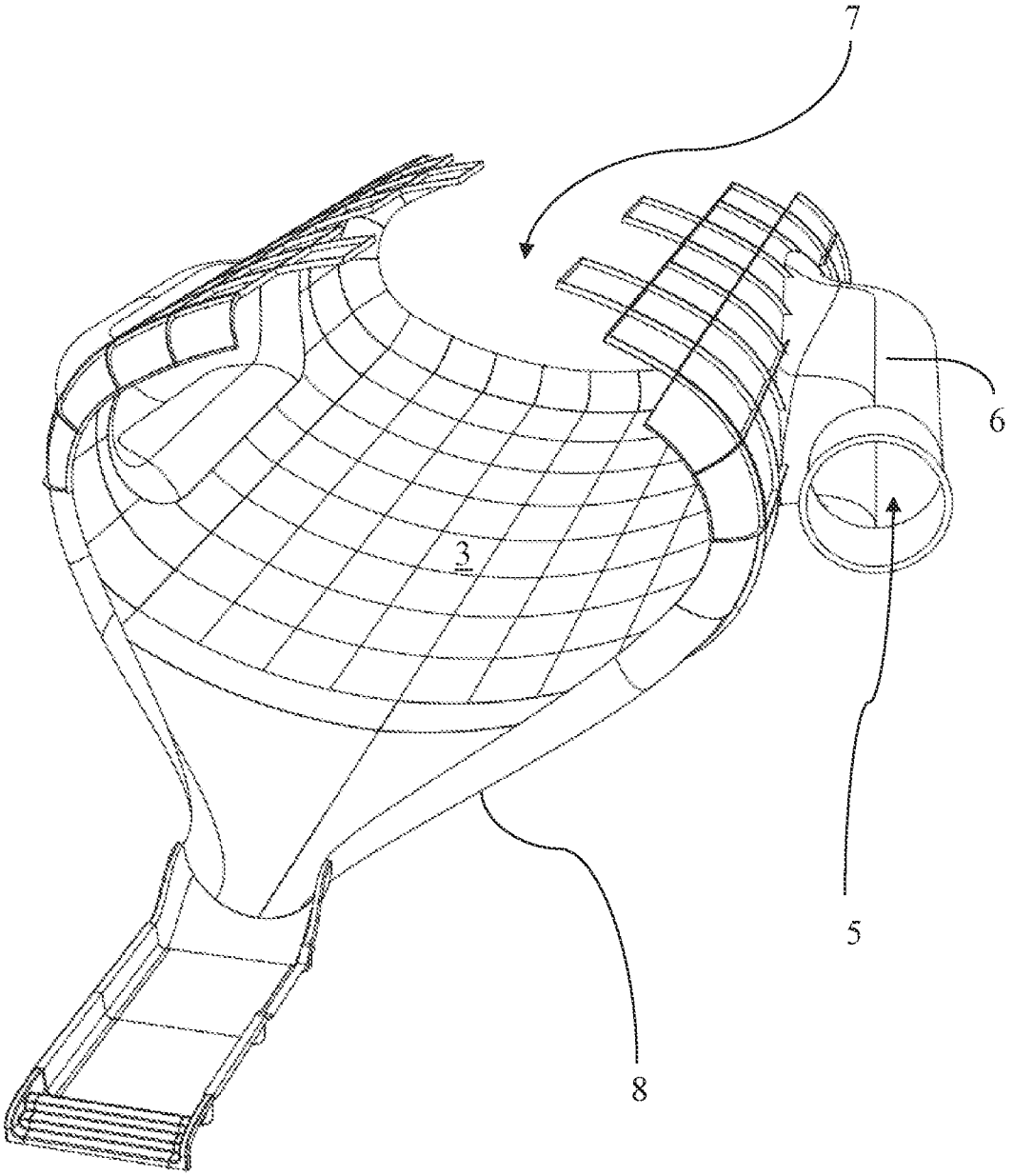
FIG. 8 is the perspective view from the front end of the structure for waterslides in one exemplary embodiment of the present invention where the top of the body is open.

The elements illustrated in the figures are numbered as follows:

1. Body
2. Side wall
3. Bottom wall
4. Front end
5. Rider opening
6. Substantially half tubular wall
7. Back end
8. Discharge spout
T. Top of the body
α. Angle between the bottom wall (3) and a surface tangent to the front end (4)
β. Angle between the top (T) surface and a surface tangent to the front end (4)
γ. Angle between a line passing through center of the substantially half tubular wall (6) and a surface tangent to the front end (4)
a. Path of a rider entering into the rider opening at a speed a
b. Path of a rider entering into the rider opening at a speed b, b>a
c. Path of a rider entering into the rider opening at a speed c, c>b
d. Path of a rider entering into the rider opening at a speed d, d>c
e. Path of a rider entering into the rider opening at a speed e, e>d

DETAILED DESCRIPTION OF THE EMBODIMENTS

Embodiments of the present invention relates to a structure for waterslides comprising a body (1) in a form of prolate ellipsoid compressed/flattened from top (T) and bottom (from its equator); having side walk (2) and a bottom wall (3); and an open front end (4) (a pole) for rider exit; a lateral rider opening (5), preferably facing the open front end (4), for connecting at least a waterslide disposed almost parallel to at least a side wall (2); where at least a part of the side wall (2) is protruding in a form of a substantially half tubular wall (6) an end of which is connected to the rider opening (5).

In one embodiment of the structure for waterslides which is applicable for all embodiments, the lateral rider opening (5) is adapted to accept one or more rider with or without a ride vehicle such as boat.

In one embodiment of the structure for waterslides which is applicable for all embodiments, the body (1) has a back end (7) which can be close for mounting special effect (light and/or sound) equipment on it or open for increased ventilation and/or showing environment/sky to the rider. In one embodiment having open back end (7), at least one part of the edge of the open back end (7) curved for providing a guide to water. The open back end (7) may be round, oval, elliptical or oblong form in shape.

In one embodiment of the structure for waterslides which is applicable for all embodiments, the open front end (4) may be round, oval, elliptical or oblong form in shape.

In one embodiment of the structure for waterslides which is applicable for all embodiments, the open front end (4) and open back end (7) substantially have the same form in shape.

In one embodiment of the structure for waterslides which is applicable for all embodiments, the top of the body (1) is open for increased ventilation and/or showing environment/sky to the rider.

In one embodiment of the structure for waterslides which is applicable for all embodiments, at least one part of the edge of the open front end (4) is curved for providing a guide to water.

In one embodiment of the structure for waterslides which is applicable for all embodiments, the structure for waterslides comprising a discharge/pour spout (8) for providing a guided rider exit connected to edge of the bottom wall (3). The discharge/pour spout (8) preferably has a V or O or U cross section and preferably side wall (2) edges of which are curved for providing a guide to water. End of the discharge/pour spout (8) is for connecting a waterslide or a pool or another waterslide structure.

In one embodiment of the structure for waterslides which is applicable for all embodiments, diameter of the front end (4) of the body (1) is bigger than the back end (7). In other word, diameter of the body (1) is getting smaller progressively from the front end (4) to the back end (7). Angle between the bottom wall (3) and a surface tangent to the front end (4) (α), angle between the top (T) surface and a surface tangent to the front end (4) (β), angle between a line passing through center of the substantially half tubular wall (6) and a surface tangent to the front end (4) (γ) may be selected to determine path of a rider.

Figure 9:
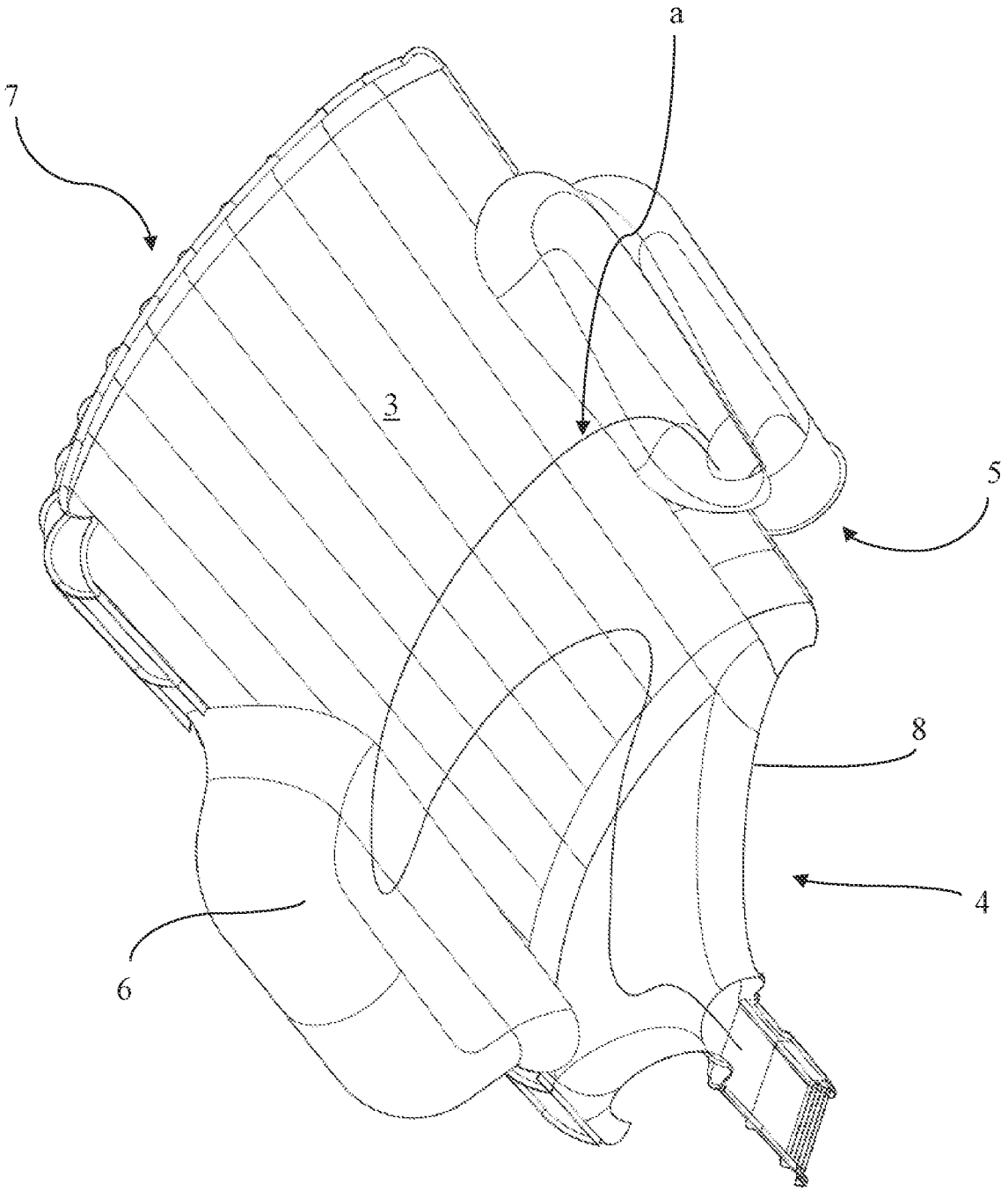
Figure 10:
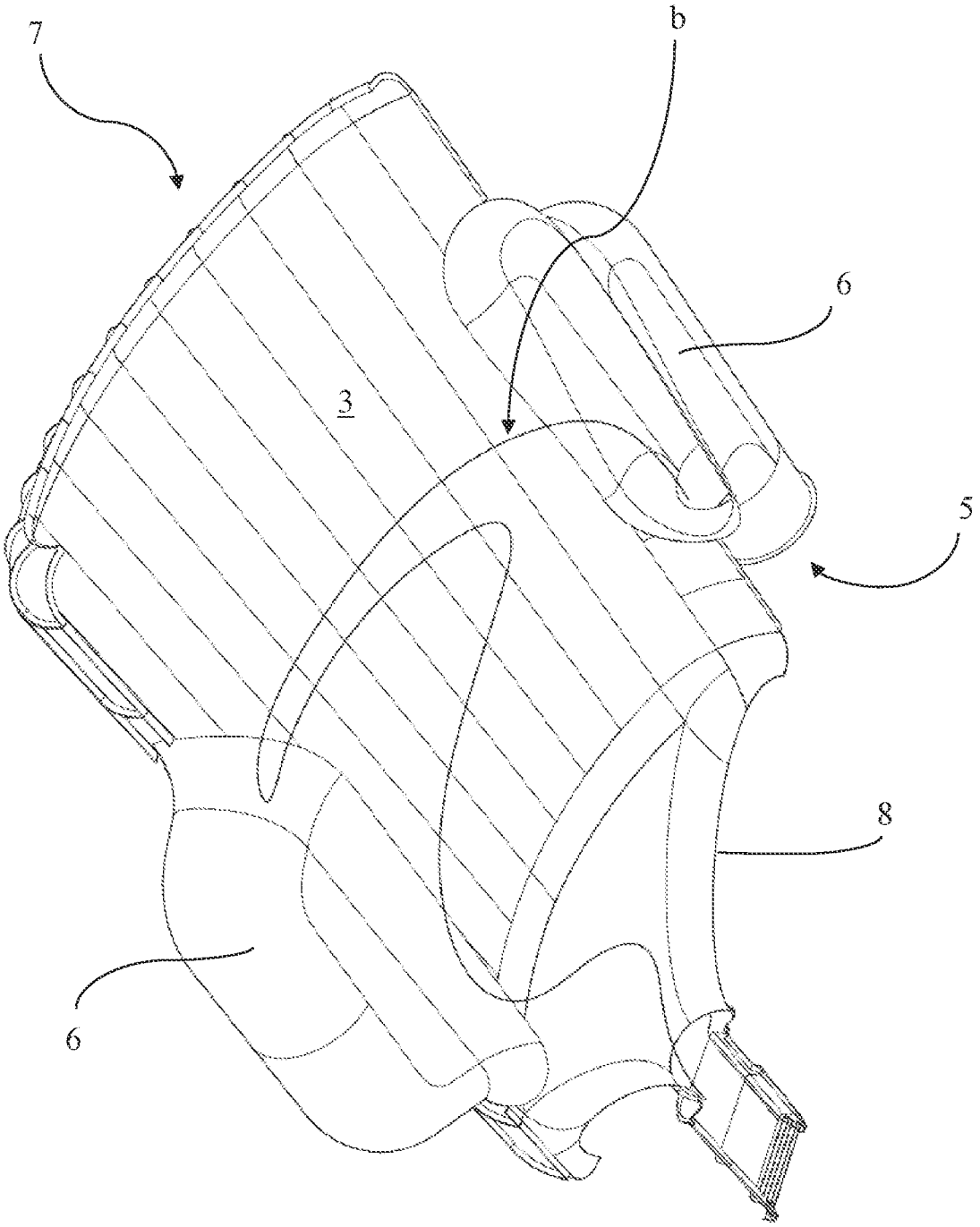
Figure 11:
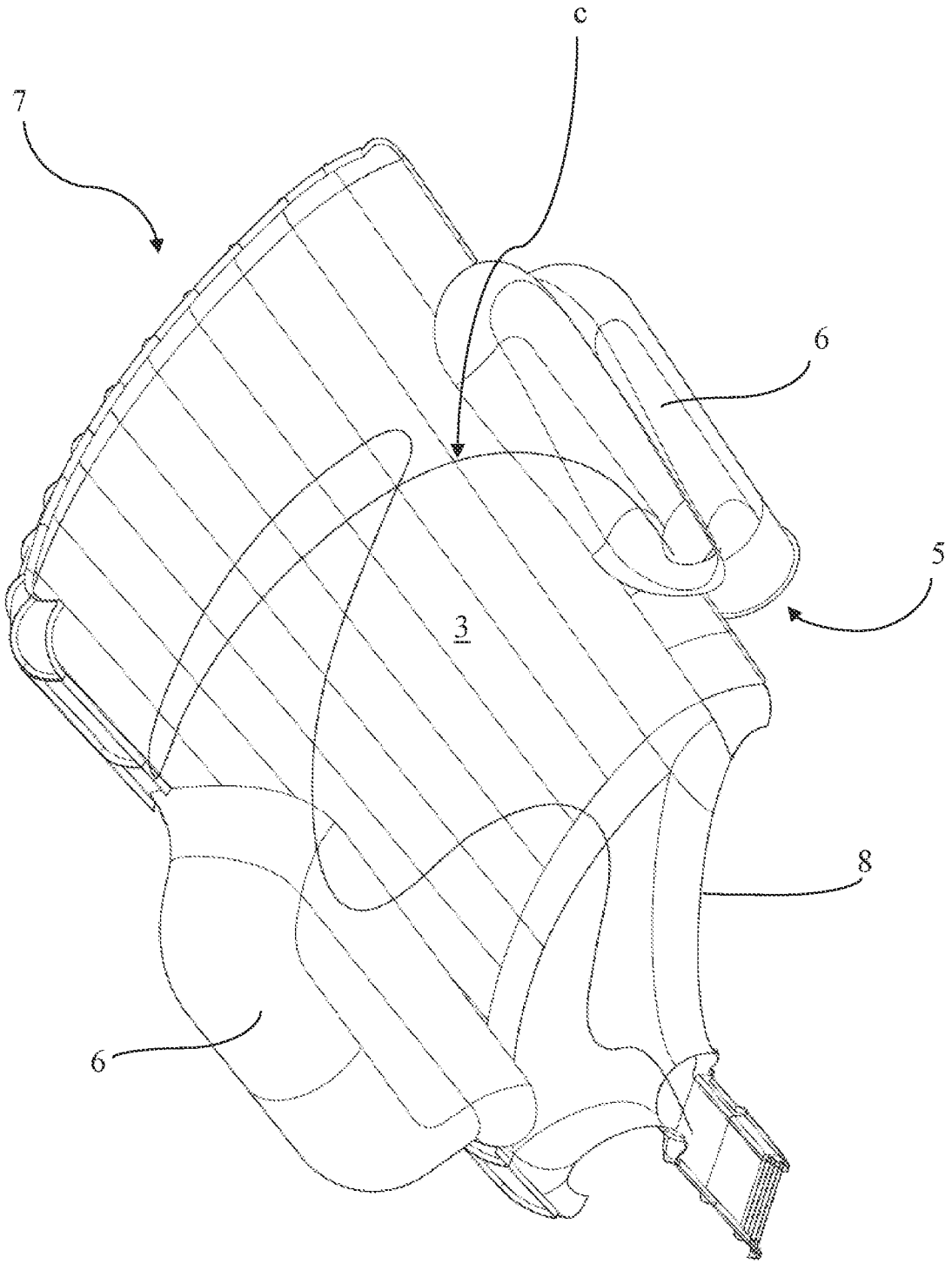
FIG. 11 is the perspective view from the front end of the structure for waterslides in one exemplary embodiment of the present invention showing the path of a rider who enters into the rider opening at a speed c, c>b.
Figure 12:
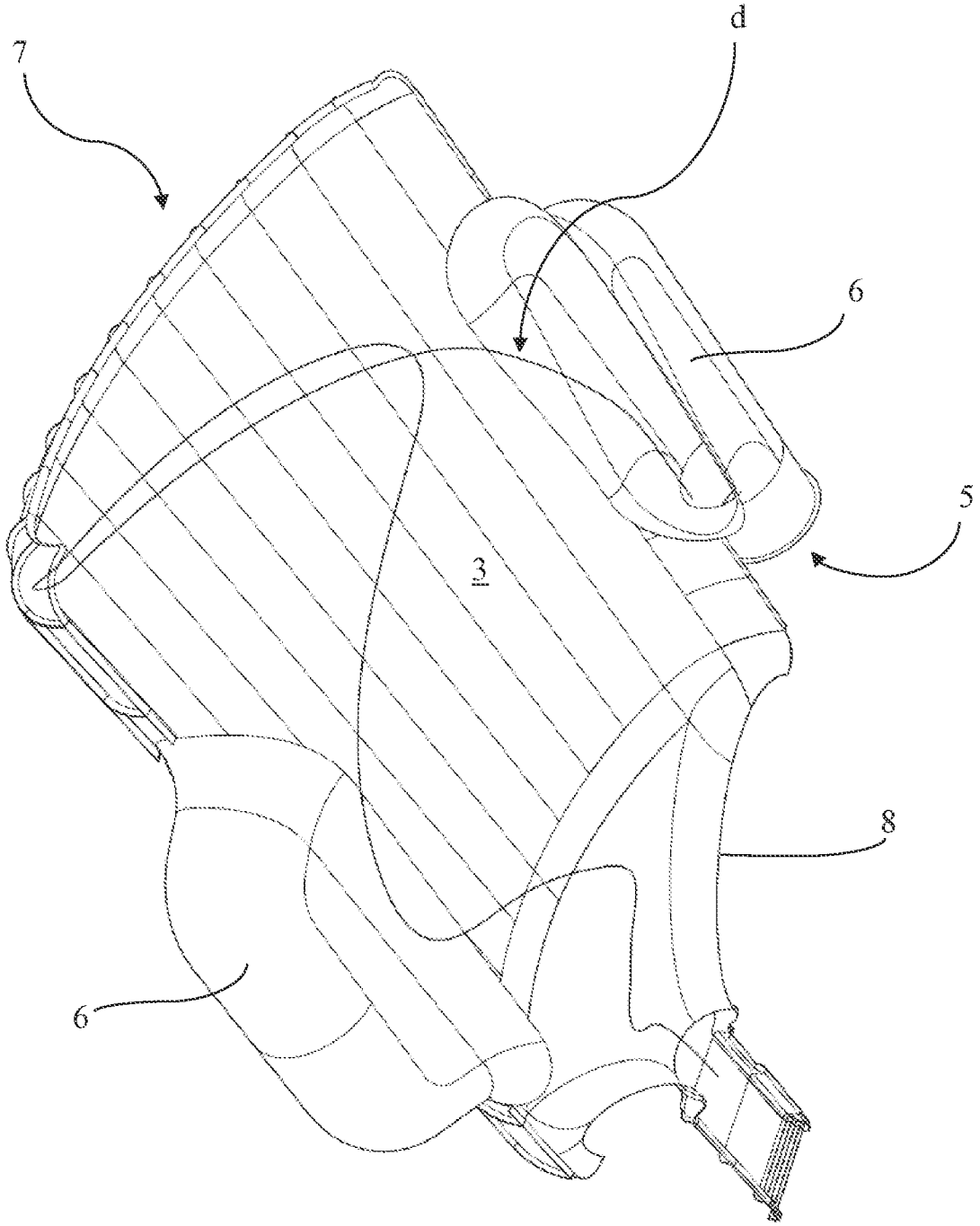
FIG. 12 is the perspective view from the front end of the structure for waterslides in one exemplary embodiment of the present invention showing the path of a rider who enters into the rider opening at a speed d, d>c.
Figure 13:
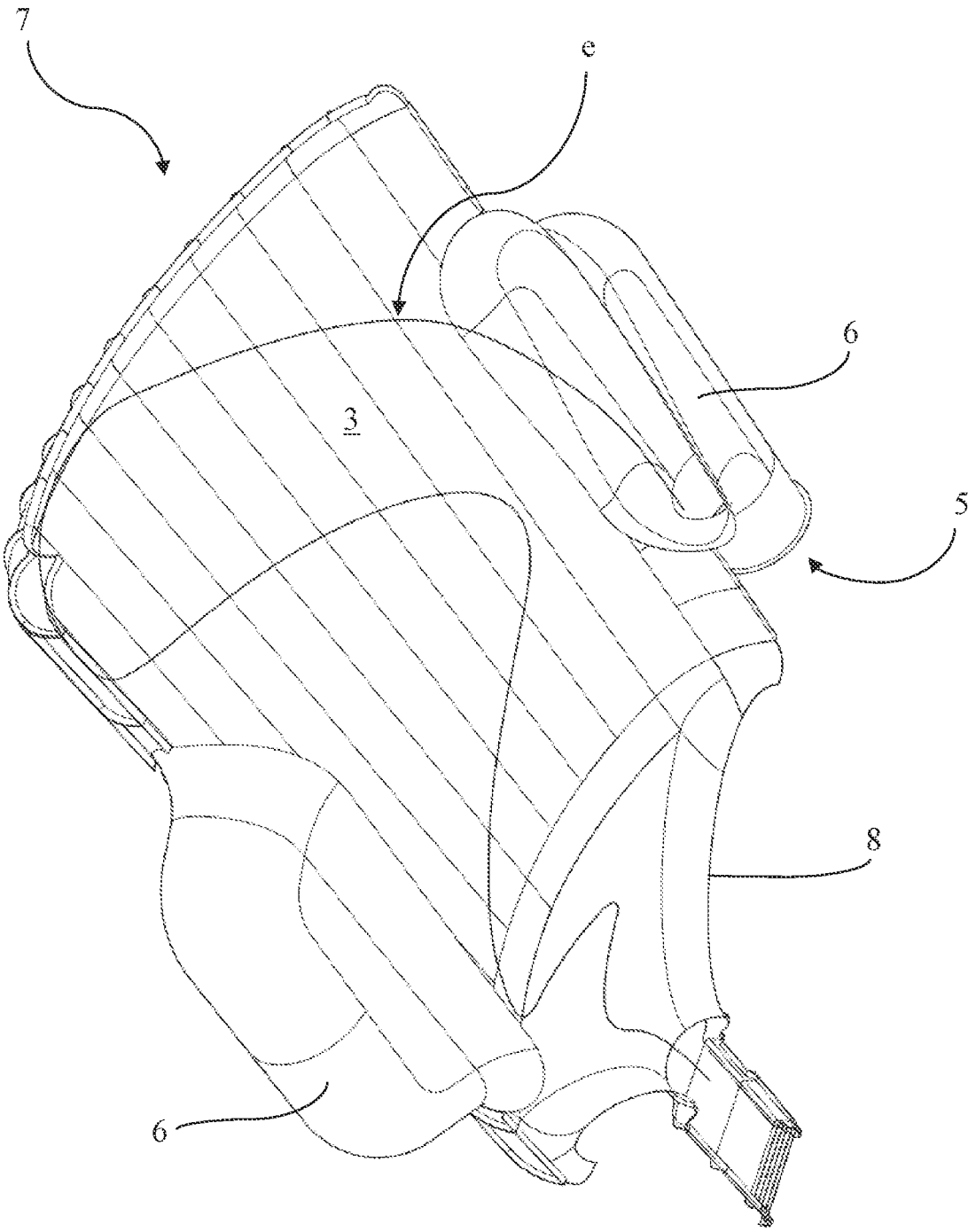
FIG. 13 is the perspective view from the front end of the structure for waterslides in one exemplary embodiment of the present invention showing the path of a rider who enters into the rider opening at a speed e, e>d.

In all embodiment of the protruding part of the side wall (2) providing the substantially half tubular wall (6) elongates substantially parallel to the side wall (2). Protruding part/substantially half tubular wall (6) form constitutes a multipoint rider opening (5) (entrance inside the curved body (1) (prolate ellipsoid form)) by enlarging lateral slide entrance. The said multipoint rider opening (5) provides substantially different entry points for riders with different speeds where riders follow substantially different paths and trajectories which grants thrilling and safe ride. When a rider with or without ride vehicles enters the structure from the lateral rider opening (5), paths and trajectories of the rider differs regarding the speed of the rider. Faster rider moves forward longer through inside the substantially half tubular wall (6) than slower riders (See FIG. 9). After, the rider moves through inside the curved bottom wall from the different part of the substantially half tubular wall (6). Inside the curved bottom wall, the riders is exposed to a back and forth (oscillating) motion between side walls (2) and/or spin motion. During the back and forth motion where the rider is getting slower, the riders also moves from back end (7) (and side walls (2) of the body (1) inside) to the open front end (4) where through the rider exits. In one embodiment of the structure for waterslides, the rider exits through discharge/pour spout (8).

In one embodiment of the structure for waterslides which is applicable for all embodiments, at least a part of the side wall is protruding in a form of a substantially half tubular wall (6) an end of which connected to the rider opening (5) and the at least a part of the other side wall (2) (opposite to the aforementioned side wall (2)) is protruding in a form of a substantially half tubular wall (6) and not connected to a rider opening (5) for such as providing symmetry.

Figure 14:
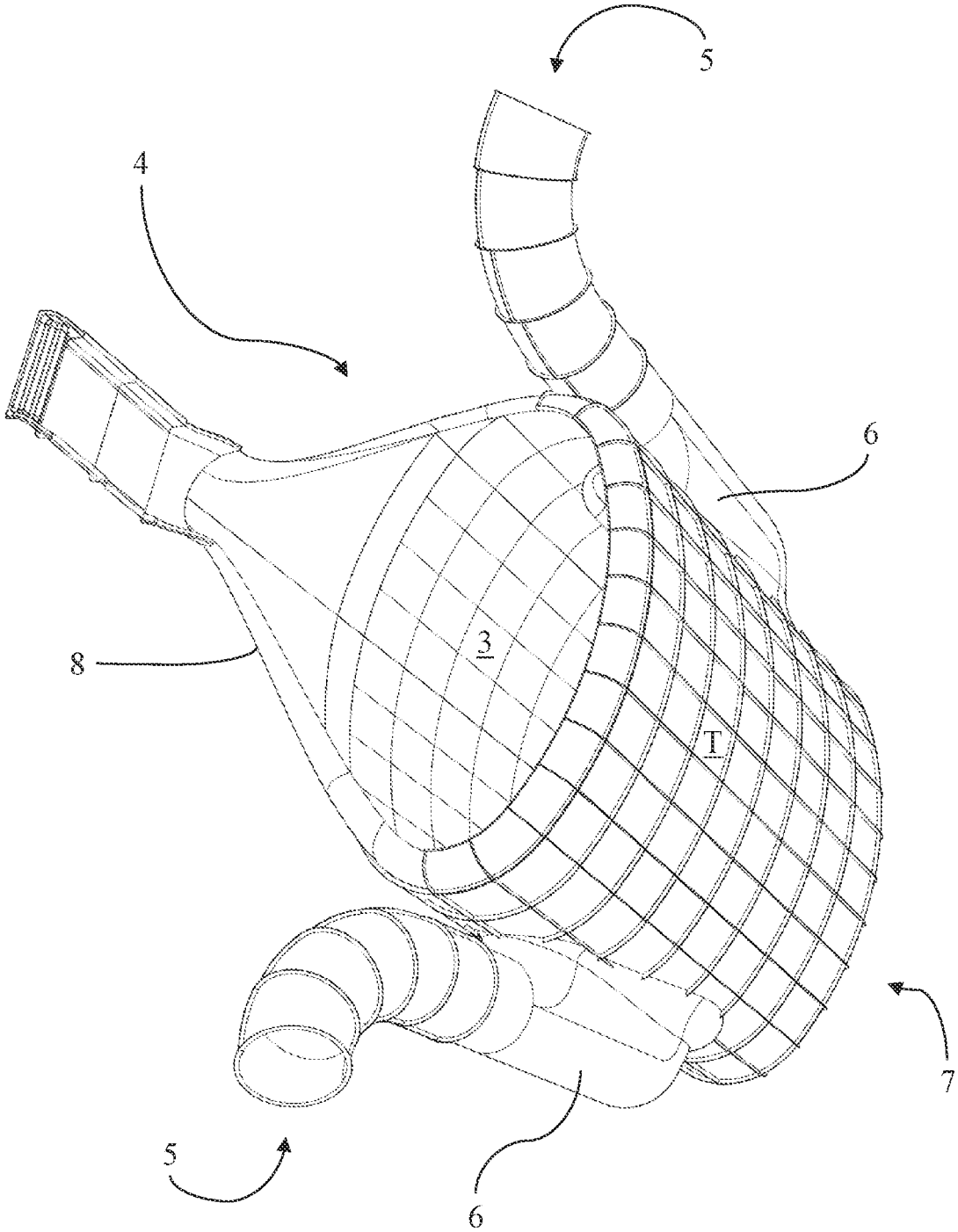
FIG. 14 is the perspective view from the front end of the structure for waterslides in one exemplary embodiment of the present invention where the structure has two substantially half tubular walls both end of which are connected to separate rider openings for connecting at least a waterslide.

In one embodiment of the structure for waterslides which is applicable for all embodiments, at least a part of the both side walls (2) are protruding in a form of a substantially half tubular wall (6) an end of which connected to the rider opening (5) (FIG. 14). In this embodiment, the structure has two substantially half tubular walls both end of which are connected to separate rider openings for connecting at least a waterslide. Thus, riders are able to have sliding experience from both side of the structure which can be a reason for preference for left-handed or right-handed riders. On the other hand, having two substantially half tubular walls both end of which are connected to separate rider openings for connecting at least a waterslide provides versatility to the waterparks. During out of service periods in one waterslide which is for connecting the one of the rider opening, the riders can continue to use the structure from the other rider opening which is for connecting an other waterslide. In this way, the structure is always ready to use in the case of maintenance, renovation or malfunction etc. on one of the waterslide which is connected to one of the rider opening, of the structure.

In one embodiment of the structure for waterslides which is applicable for all embodiments, the structure for waterslides comprises speed control systems such as (not limited to) nozzle systems, water jet systems, pneumatic systems, air-based systems for controlling velocity of the rider and also diversifying more alternative sliding paths and/or specifying more accurate and more safe sliding paths.

What is claimed is:

1. A structure for waterslides, comprising:

a body in a form of a prolate ellipsoid compressed from top and bottom;

a first side wall and a second side wall and a bottom wall; and an open front end for a rider exit;

a lateral rider opening for connecting at least a waterslide disposed parallel to the first side wall; wherein at least a part of the first side wall is protruding in a form of a first half tubular wall and an end of the first half tubular wall is connected to the lateral rider opening.

2. The structure according to claim 1, wherein the body comprises a back end.

3. The structure according to claim 2, wherein a diameter of the open front end of the body is bigger than a diameter of the back end.

4. The structure according to claim 1, wherein the lateral rider opening faces the open front end.

5. The structure according to claim 1, wherein at least one part of an edge of the open front end is curved for providing a guide to water.

6. The structure according to claim 1, comprising a discharge/pour spout for providing a guided rider exit connected to an edge of the bottom wall.

7. The structure according to claim 6, wherein the discharge/pour spout has a V cross-section or an O cross-section or a U cross-section.

8. The structure according to claim 7, wherein side wall edges of the discharge/pour spout are curved for providing a guide to water.

9. The structure according to claim 6, wherein side wall edges of the discharge/pour spout are curved for providing a guide to water.

10. The structure according to claim 1, wherein at least a part of the second side wall is protruding in a form of a second half tubular wall and the second half tubular wall is not connected to a rider opening.

* * * * *